United States Patent [19]

Wu

[11] Patent Number: 4,948,633

[45] Date of Patent: Aug. 14, 1990

[54] METHOD FOR PAINTING AN ARTICLE

[76] Inventor: Mu-Lin Wu, No. 6, Lane 411, Gan-Chu Rd., Ho-Meei Chen, Chang-Hua Hsien, Taiwan

[21] Appl. No.: 397,286

[22] Filed: Aug. 23, 1989

[51] Int. Cl.[5] ..... B05D 3/00; B05D 3/02; B05D 5/00

[52] U.S. Cl. ..... 427/262; 427/264; 427/267; 427/270

[58] Field of Search ..... 427/262, 263, 264, 267, 427/268, 270

[56] References Cited

U.S. PATENT DOCUMENTS 1,413,429 4/1922 Robson ..... 427/262

1,902,522 3/1933 Rose ..... 427/262

*Primary Examiner*—Evan Lawrence

*Attorney, Agent, or Firm*—Oblon, Spivak, McClelland, Maier & Neustadt

[57] ABSTRACT

A method for painting an article includes the steps of dipping the article in a mixture of varnish and silicone rubber so as to form a protective film on the surface of the article; priming the protective film; spray painting the article so as to form a plurality of paint flecks to form a plurality of patterns on the article; applying a solvent to the article to dilute the paint flecks; air-drying the article; polishing the surface of the article; forming a layer of epoxide resin on the surface of the article; and bake varnishing the article. In this way, the surface of the article is given a flecked and glossy surface.

5 Claims, 1 Drawing Sheet

METHOD FOR PAINTING AN ARTICLE

BACKGROUND OF THE INVENTION

This invention relates to a method for painting an article, and more particularly to a method for painting which provides an article made of a metal or plastic material with a glossy, flecked surface.

A conventional method for painting a metal or plastic article includes the steps of dipping said article in a mixture of varnish and silicone rubber so as to form a protective film on the surface thereof; making sure said protective film is applied evenly on the surface of said article; and bake varnishing (applying a varnish and then baking) said article at a temperature ranging from 150° C. to 200 ° C. The resulting article is usually painted with a monochromatic paint and lacks of attractive appearance. In addition, the conventional method of painting does not include the steps of applying and polishing a protective layer after baking varnishing the article. Hence, the finished surface of the article is not glossy in appearance.

SUMMARY OF THE INVENTION

It is therefore a main object of this invention to provide a method for painting an article which includes the step of spray painting the article so as to give the article a flecked surface, increasing the aesthetic quality thereof.

It is another object of this invention to provide a method for painting an article which includes the steps of polishing said painted surface of the article and applying a layer of epoxide resin thereon so as to gloss and protect said surface of said article.

Accordingly, a method for painting an article comprises the steps of dipping said article in a mixture of varnish and silicone rubber so as to form a protective film on the surface of the article; priming said protective film; spray painting the article so as to form a plurality of paint flecks thereon; applying a solvent onto the article to dilute said paint flecks; air-drying the article; polishing the surface of the article; applying a layer of epoxide resin on the surface of the article; and bake varnishing the article. In this way, the surface of the article is given a flecked and glossy surface, increasing the aesthetic quality thereof.

BRIEF DESCRIPTION OF THE DRAWING

Other features and advantages of this invention will become apparent in the following detailed description of a preferred embodiment of this invention with reference to the accompanying drawing, in which.

DETAILED DESCRIPTION OF THE PREFERRED EMBODIMENT

Figure 1:
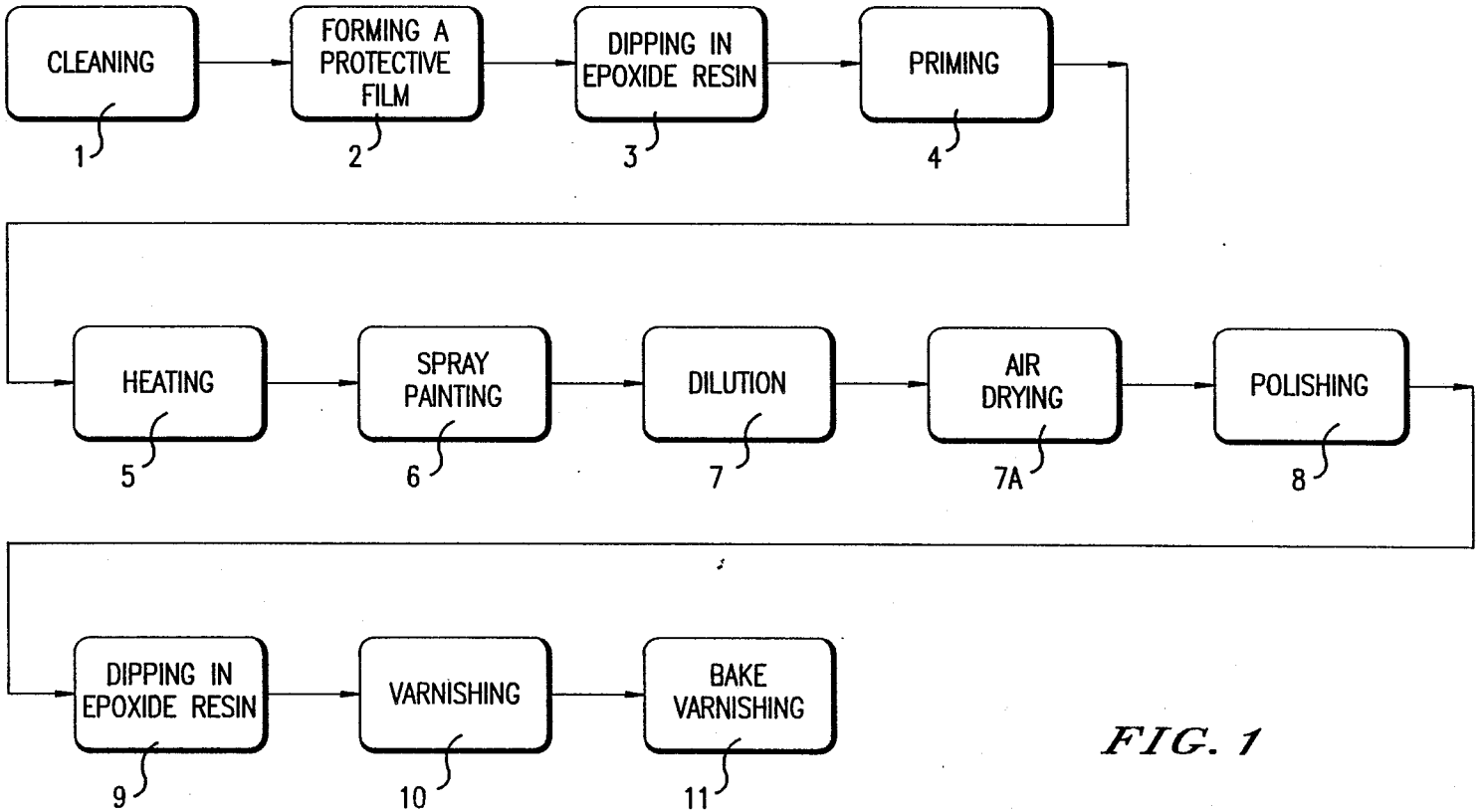
FIG. 1 is a flow diagram of a preferred embodiment of a method for painting an article according to this invention.

Referring to FIG. 1, a flow diagram of a preferred embodiment of a method for painting a metal or plastic article according to this invention is shown. The article is first cleaned with water (metal article being cleaned by means of exposure to supersonic waves for about 4 to 5 minutes), as illustrated in block 1. Afterwards, the article is dipped into a mixture of varnish and silicone rubber so as to form a protective film on the surface thereof, as illustrated in block 2. The article is then dipped into epoxide resin solution for about 4 to 5 minutes so as to form a first 0.03 mm layer of epoxide resin on said protective film, as shown in block 3. Following this step, the article is sprayed by a primer of a predetermined color, such as white, blue, red, etc. If desired, the article may also be painted with various colors, as shown in block 4. The paint is cured by means of heating said article at a temperature ranging from 150° C. to 200° C., as shown in block 5. It is noted that the lower the heating temperature and the longer the heating time applied to said article, the better the priming effect thereof. Spray painting the article provides the surface of the article with a plurality of paint flecks. The paint flecks may be of different colors depending on the requirements of the manufacturer, as shown in block 6. After the application of the spray paint, the paint flecks are diluted by spraying a solvent, such as toluene, etc., onto the article so as to form a plurality of patterns, as shown in block 7. After the solvent is evaporated by an air-drying process, block 7A, the article is polished by cloth wheels so as to give an external surface thereof, as shown in block 8. The article is then dipped in an epoxide resin for 4 to 5 minutes so as to form a second layer of epoxide resin, as shown in block 9. After air-drying the epoxide resin layer, a layer of varnish is applied on the article, as shown in block 10. Finally, the article is backing varnished at a temperature ranging from 150° C. to 200° C., as shown in block 11.

In accordance with the present invention, the resulting article is provided with a flecked and glossy surface. The paint applied to the surface of the article is protected by the layers of epoxide resin and varnish so that the paint color will not fade.

With this invention thus explained, it is apparent that numerous modifications and variations can be made without departing from the scope and spirit of this invention. It is therefore intended that this invention be limited only as indicated in the appended claims.

I claim:

1. A method for painting a surface of an article comprising the steps of dipping said article in a mixture of varnish and silicone rubber so as to form a protective film on said surface thereof; and priming, painting and bake varnishing said protective film; wherein the improvement comprises, after priming said protective film, spray painting said article so as to form a plurality of paint flecks thereon; applying a solvent on said article to dilute said paint flecks to form a plurality of patterns; and air-drying said article.

2. A method for painting the surface of an article as claimed in claim 1 further comprising, dipping said article in an epoxide resin after dipping said article in a mixture of varnish and silicone rubber.

3. A method for painting the surface of an article as claimed in claim 2 further comprising, polishing said article after said article has been air-dried.

4. A method for painting the surface of an article as claimed in claim 3 further comprising, dipping said article in an epoxide resin after said article has been polished.

5. A method for painting the surface of an article as claimed in claim 4 further comprising, varnishing said article after said article has been dipped in an epoxide resin.

* * * * *